US005332351A

United States Patent [19]

Nelson et al.

[11] Patent Number: 5,332,351

[45] Date of Patent: Jul. 26, 1994

[54] COIL UNLOADING AND TRANSPORTATION APPARATUS AND METHOD

[76] Inventors: Jacqueline S. Nelson, 118 Eastgate La., Hamden, Conn. 06514; Louis J. Wither, 20 Tanglewood Dr., Branford, Conn. 06405; Daniel J. Cummings, 35 Sheffield Rd., North Haven, Conn. 06473; Elliot R. Lang, 1730 State St., Hamden, Conn. 06517

[21] Appl. No.: 929,462

[22] Filed: Aug. 11, 1992

Related U.S. Application Data

[63] Continuation of Ser. No. 720,898, Jun. 25, 1991, abandoned.

[51] Int. Cl.[5] ..... B66F 11/00

[52] U.S. Cl. ..... 414/684; 414/786; 414/911

[58] Field of Search ..... 414/684, 908, 910, 911, 414/27, 778, 786; 242/58.6, 79; 198/574

[56] References Cited

U.S. PATENT DOCUMENTS

| | | | |
|---|---|---|---|
| 2,700,332 | 1/1955 | Donald | 414/684 X |
| 3,545,632 | 12/1970 | Cooper | 414/27 |
| 4,358,143 | 11/1982 | Cullen | 414/684 X |
| 4,718,813 | 1/1988 | Kehlenbach | 414/684 |
| 4,728,248 | 3/1988 | Martins | 414/684 |

*Primary Examiner*—Michael S. Huppert
*Assistant Examiner*—Donald W. Underwood
*Attorney, Agent, or Firm*—St.Onge Steward Johnston & Reens

[57] ABSTRACT

A coil unloading and transporting apparatus is disclosed and is suited for unloading coiled aluminum and other metals from a storage shaft and moving the coils from the storage shaft to a pallet for further transport. The unloading and transporting apparatus comprises a carriage movable from a position adjacent the storage shaft to a position remote from the storage shaft. A platform for supporting the coil is mounted on the carriage and a receiving shaft extends outwardly from the platform. The storage shaft can be withdrawn below the plane of the platform. The platform and the receiving shaft is pivotal from a position wherein the receiving shaft is horizontal and the coil is supported on the receiving shaft to a position wherein the receiving shaft is vertical and the coil is supported on the platform. Once the coil is supported on the platform, the receiving shaft may be withdrawn below the platform, and the coil transported by the carriage to a remote location.

25 Claims, 6 Drawing Sheets

104
20
94
88
12
92
98
102
120
60
68
52
50
18
44
40
38
48
54
22
14
71
70
84
82
62
106
108
10
66

COIL UNLOADING AND TRANSPORTATION APPARATUS AND METHOD

This is a continuation of copending application Ser. No. 07/720,898 filed on Jun. 25, 1991, now abandoned.

BACKGROUND OF THE INVENTION

1. Field of the Invention

The present invention relates to a coil unloading and transporting apparatus for a coil mounted on a storage shaft. In manufacturing operations for large coils of metal, such as aluminum, brass, steel and the like, one begins with large coils of metal alloys. These coils can have a diameter of three to six feet or more, and weigh thousands of pounds. In order for these large coils of metal to be utilized in further manufacturing processes, they must be slit by a device termed a slitter into a group of coil segments having a width as small as several inches. Thus, the large coil is placed on a slitter, and may be cut into ten to fifteen narrow coils. During the process of slitting, the group of coils are wound on a horizontal storage shaft that is part of the slitting device.

The slit coils are heavy and cumbersome to move from the storage shaft where they are stored horizontally to a pallet where they are stored vertically and separated from each other by spacer between each coil.

One prior art apparatus for removing slit coils from the storage shaft of a slitter rewinder is a coil car. In essence, the coil car is moved adjacent the storage shaft, and the coil car has an arcuate bed for receiving the group of coils as it is pushed off of the storage shaft of the slitter rewinder. Once the coil is on the coil car, this coil car is moved to a remote location where it is unloaded by a stationary apparatus referred to as a down-ender. The coil car is an expensive piece of equipment, and additional material-handling apparatus is required, such as down-ender, to remove the slit coils from the coil car.

Thus, it is an object of the present invention to provide a coil unloading and transporting apparatus that will automatically and in rapid motion unload the group of slit coils from the storage shaft, move the slit coils quickly away from the storage shaft, move the slit coils from a horizontal to a vertical position wherein they can be separated and loaded onto pallets.

It is a further object of the invention to provide an apparatus by which the group of slit coils can, once they are in a vertical position, be quickly transported laterally to an elongate conveyor where the coils may be separated and loaded onto a pallet for delivery to the ultimate user.

It is a further object of the invention to provide an apparatus which can unload a coil, transport the coil, and be prepared to receive another coil in a short period of time.

SUMMARY OF THE INVENTION

In accordance with the present invention, a coil unloading and transporting apparatus is provided for unloading a coil mounted on a storage shaft of a slitter rewinder. The apparatus comprises a carriage which is movable from a position adjacent the storage shaft to a position remote from the shaft. The carriage has a platform mounted thereon. The apparatus further includes a receiving shaft, which in its extended position, protrudes from the platform and is moveable to a withdrawn position wherein the receiving shaft is withdrawn below the plane of the platform. The apparatus includes a mechanism for pivoting the platform and the receiving shaft from the position wherein the receiving shaft is horizontal and the coil is supported on the receiving shaft to a position wherein the receiving shaft is vertical and the coil is supported on the platform. The apparatus also includes a mechanism for aligning the receiving shaft axis with the storage axis to enable transfer of the coil from the storage shaft to the receiving shaft.

In operation, the carriage is moved to the storage shaft with the receiving shaft aligned with the storage shaft to permit transfer of the slit coils. The slit coils are moved from the storage shaft to the receiving shaft by a pusher located on the slitter recoiler. At this stage in the process, the coil is in a horizontal position and is supported on the receiving shaft. The receiving shaft and platform are then tilted by an angle between about 5 and about 10 degrees. The carriage is then moved to a remote position and the receiving shaft and its attendant platform is moved from a tilted position to a vertical position wherein the weight of the coil is transferred from the receiving shaft to the platform. The receiving shaft is then moved from the extended position and is withdrawn below the plane of the platform to permit the coils to be transported laterally with respect to the platform.

In accordance with one aspect of the invention, the platform is a conveyor for moving the coil laterally. The platform comprises a plurality of elongated rollers that are motor driven to permit the group of slit coils to be transferred laterally with respect to the platform. Thus, once the weight of the group of slit coils is fully supported on the plurality of rollers and the receiving shaft is withdrawn below the plane of the platform, the rollers are driven and the group of slit coils are transferred laterally off of the coil unloading and transporting apparatus.

In accordance with one aspect of the invention, an the elongate conveyor for transporting the group of slit coils is provided and is located adjacent the remote position of the carriage and at the height of the platform. Thus, once the carriage is moved to the remote position and the platform is pivoted to a position wherein the coil is fully supported on the platform, the rollers of the platform are driven to move the group of slit coils laterally onto the elongate conveyor, and the group of coils are transported away from the coil unloading apparatus. In accordance with a preferred aspect of the invention, the elongate conveyor comprises a plurality of elongate rollers that are driven at the same speed as are the rollers of the coil unloading apparatus.

In accordance with another aspect of the invention, an overhead crane is associated with the elongate conveyor, and is movable in at least two degrees: (1) in a direction back and forth along the direction of movement of the coil on the conveyor; and (2) up and down. The crane, which may work on a suction principle or by other means, grasps each slit coil segment, lifts the coil up and places it on a pallet. Spacers are placed on the upper surface of the individual slit coil segment and another coil segment is placed on top of the first coil segment. The coils are unloaded onto the pallet so that the group can be transported.

The elongate conveyor is preferably long enough to store at least several groups of coils, and perhaps more. The conveyor has several zones with each zone being driven by a different motor, to provide for independent operation of each zone. Thus, during the unloading operation, the coil unloading apparatus can be used repeatedly while the slit coils are stored on the elongate conveyor.

Other advantages of the present invention will be more readily apparent from the detailed description of the invention with reference to the drawings, which follows.

DETAILED DESCRIPTION OF INVENTION

Figure 1:
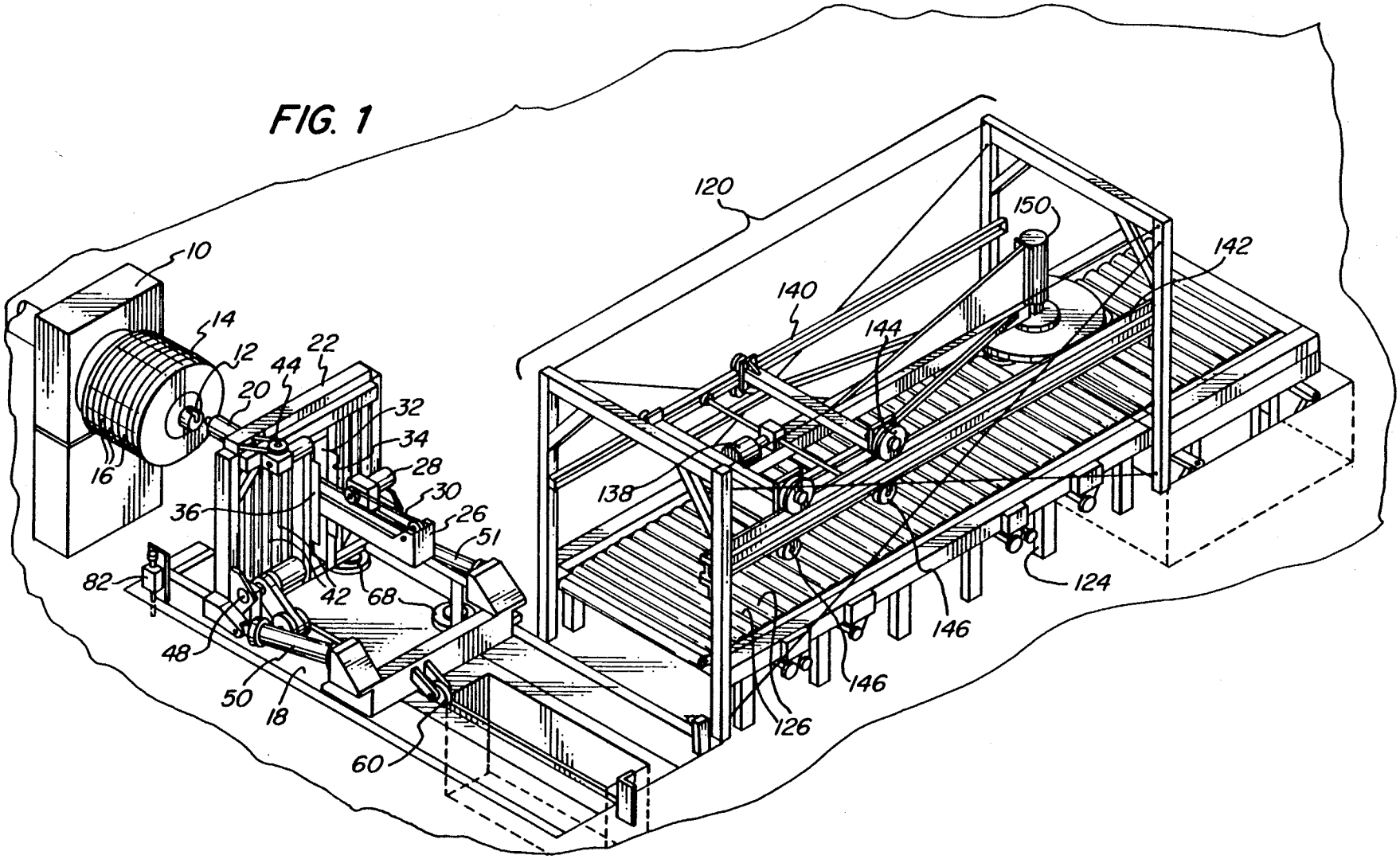
FIG. 1 is a perspective view of a coil unloading and transporting apparatus according to the present invention located adjacent a conventional slitting apparatus.

Referring to FIGS. 1 through 9, a coil unloading and transporting apparatus in accordance with the present invention is shown. FIG. 1 shows a perspective view wherein the apparatus is in a position just before it is positioned to receive a coil. Shown on the left side of FIG. 1 is a portion of a conventional slitter rewinder 10. The slitter rewinder has a storage shaft 12 extending outwardly therefrom and supporting a slit coil 14. The slit coil 14 is fabricated from a large coil that is rolled to the desired thickness and slit into a plurality of individual coil segments 16 that will eventually be shipped and utilized in other products. The coil slitter rewinder 10 shown in the figures is conventional, and the unloading and transporting apparatus of the present invention facilitates removal of the coil 14 mounted on the storage shaft 12 and subsequent loading of coil segments 16 onto a pallet for shipment.

Figure 2:
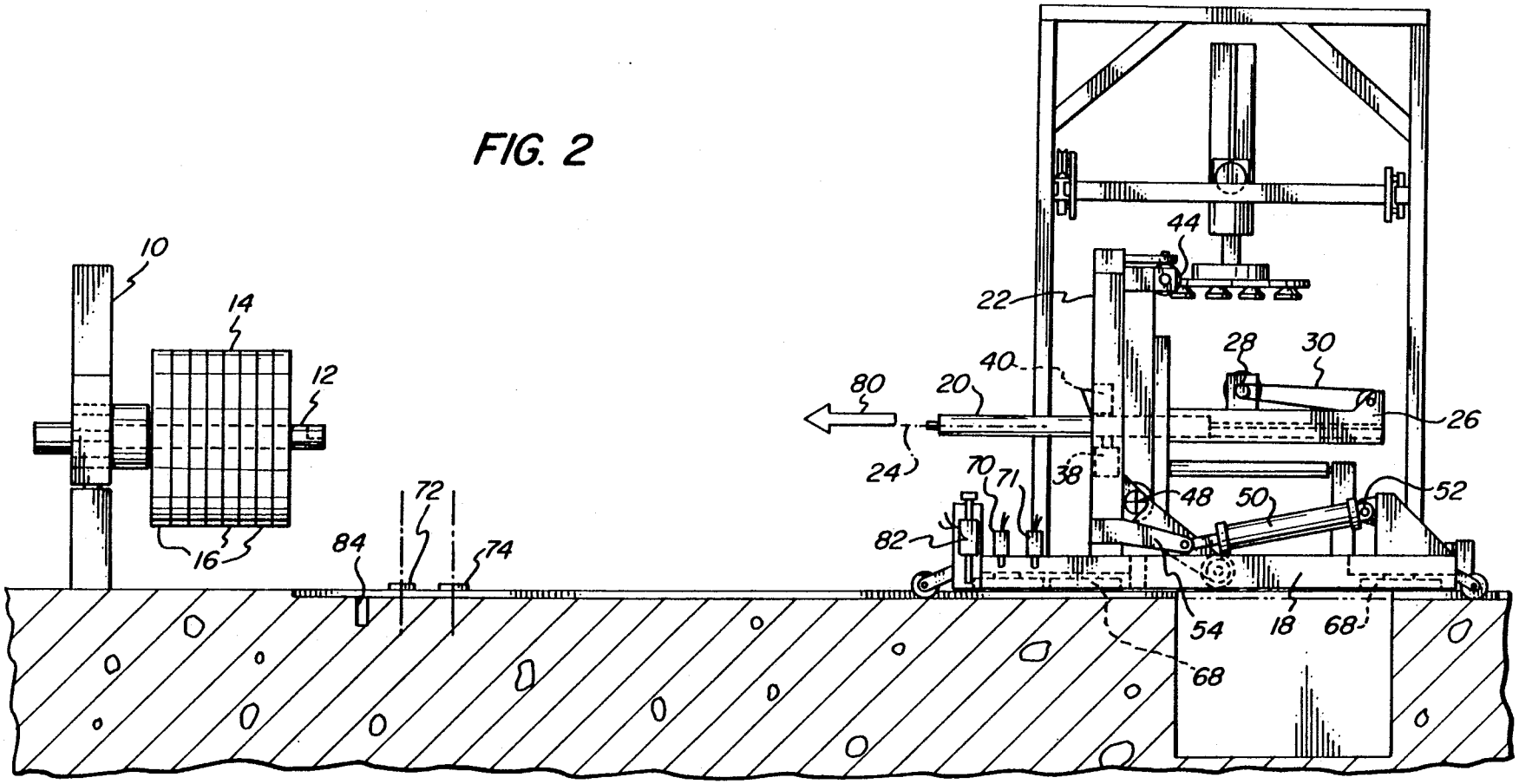
FIG. 2 shows a side view of the coil unloading and transporting apparatus shown in FIG. 1 in a position wherein the carriage is located remotely from the storage shaft.
Figures 3, 4, 5, 6:
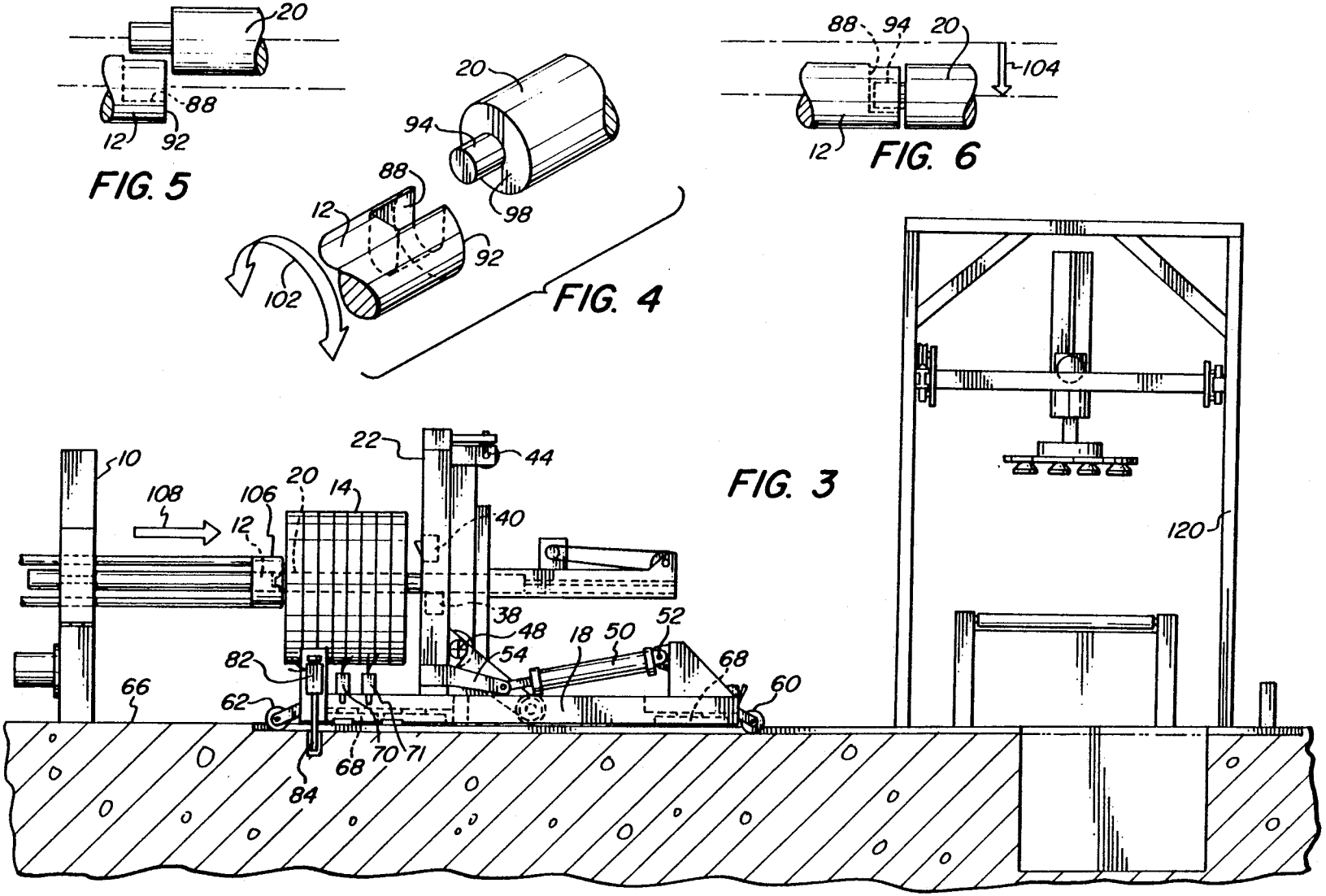
FIG. 3 is a side view similar to that shown in FIG. 2 wherein the carriage has been moved adjacent the storage shaft and the group of coils has been unloaded from the storage shaft to the receiving shaft.
FIG. 4 is a perspective view of the end of the storage shaft and the end of the receiving shaft.
FIG. 5 is a side view of the storage shaft ends shown in FIG. 4.
FIG. 6 is a side view similar to that shown in FIG. 5 except that the shafts have been now aligned in a face-to-face relation.

The apparatus in accordance with the present invention includes a carriage 18 that is movable from a position adjacent the storage shaft 12 as shown in FIG. 3 to a position remote from the storage shaft 12 as shown in FIG. 2. The carriage has mounted thereon a receiving shaft 20 for supporting the coil 14 when it is transferred from the storage shaft 12 to the receiving shaft 20.

Figure 7:
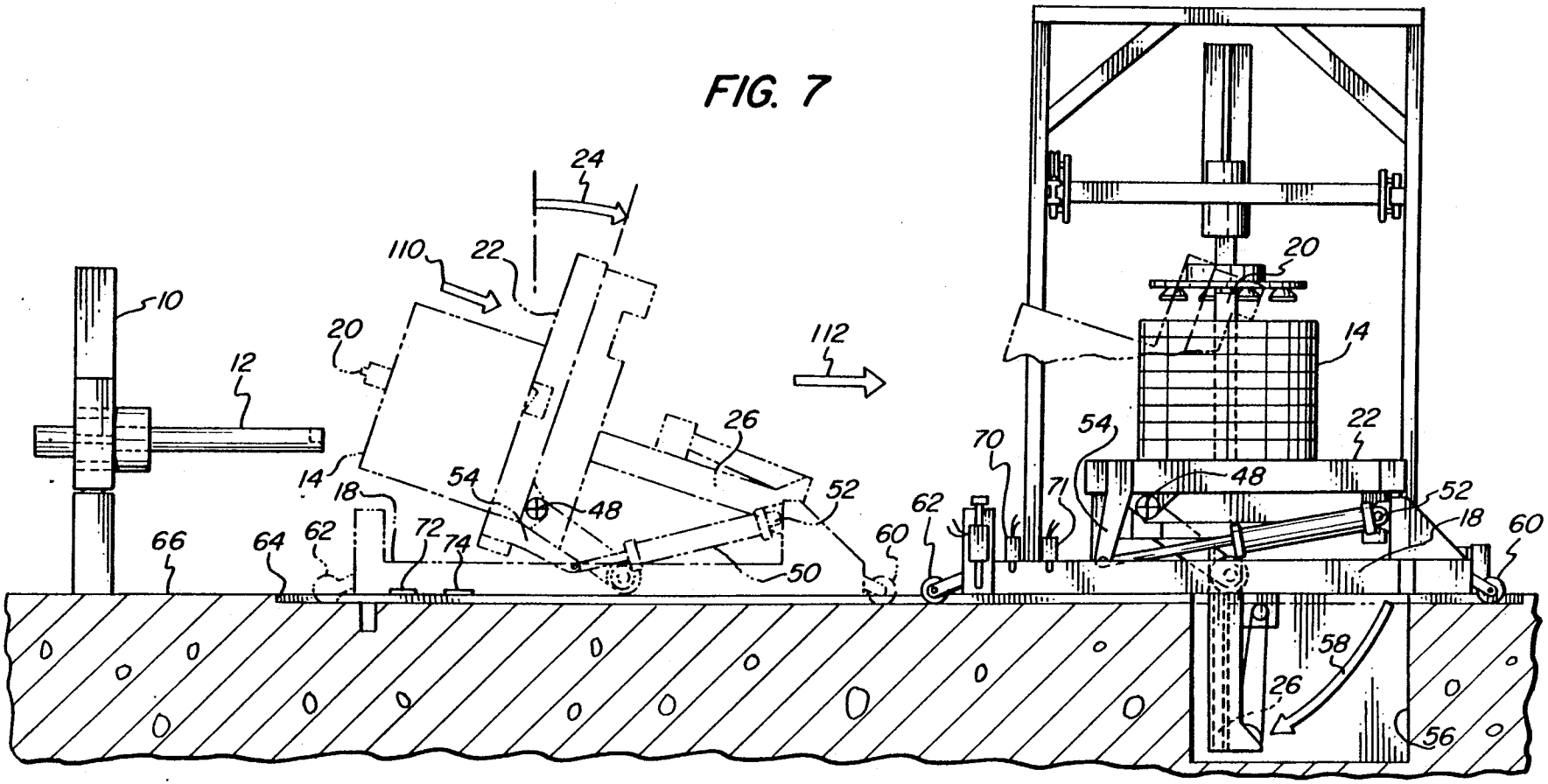
FIG. 7 is a side view similar to that shown in FIGS. 2 and 3 wherein the carriage has been partially transported away from the storage shaft, and the platform has been inclined by an angle to retain the group of coils on the receiving shaft during transport.
Figure 8:
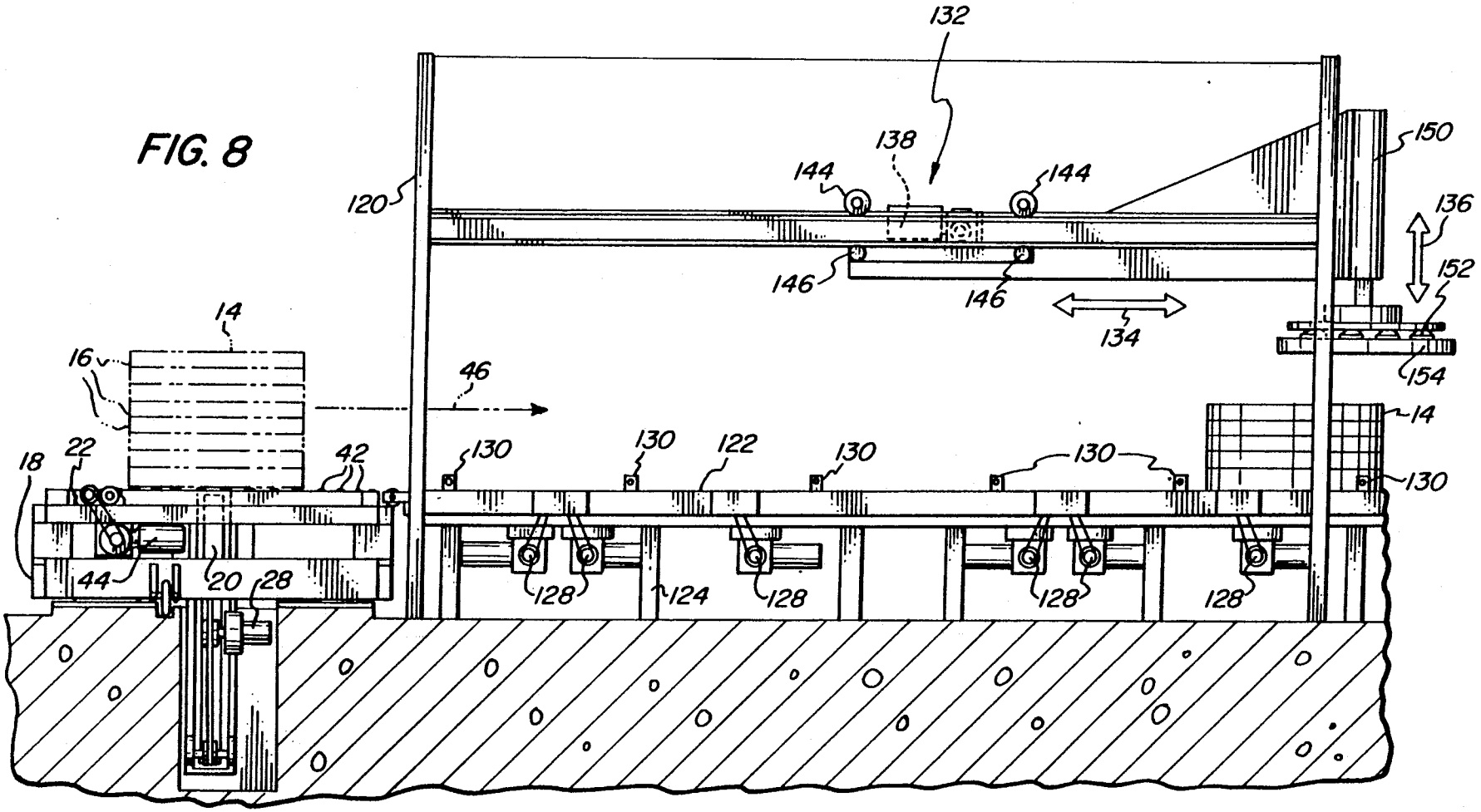
FIG. 8 is an end view of the apparatus shown in FIG. 7 after the platform has been placed in a horizontal position and the receiving shaft has been withdrawn below the plane of the platform.

The apparatus includes a platform 22 for supporting the coil 14 when the coil is in a vertical position as shown in FIG. 8. In addition, platform 22 supports the coil 14 when it is inclined as shown by the arrow 24 in FIG. 7 when the coil is being transported from the storage shaft 12 to a position remote therefrom. As is shown particularly well in FIG. 2, the receiving shaft 20 includes an axis 24, and axis 24 is perpendicular to the plane of the platform 22. The receiving shaft 20 is movable relative to the platform 22 from an extended position wherein the receiving shaft protrudes from the platform as shown in FIG. 2 to a withdrawn position wherein the shaft is withdrawn the plane of the platform as shown in FIG. 8. As best shown in FIGS. 1 and 2, the shaft 20 is journaled in a shaft housing 26 which is located behind the platform 22, movement of the shaft 20 is driven by a hydraulic motor 28 that is connected to a chain 30 that ultimately moves the shaft 20 in and out with respect to the platform 22.

As best shown in FIG. 1, the shaft 20 is slidable vertically in a slot 32 in the platform. The housing 26 which supports the shaft 20 is slidably mounted with respect to two parallel guides 34 and 36 which permit the shaft to be adjusted vertically. As shown in FIG. 2, a hydraulic piston and cylinder 38 controls the vertical movement of the shaft 20 and the vertical position of the shaft 20 is sensed by a proximity switch 40 which is mounted above the shaft. As best shown in FIGS. 1 and 8, platform 22 comprises a plurality of rollers 42 which support the weight of the slit coil 14. The rollers 42 are chain driven by an electric motor 44. When the motor 44 is actuated, the rollers turn in a clockwise direction as viewed in FIG. 8 and move the coil in the direction of arrow 46.

As can be best seen by comparing FIGS. 2, 7, and 8, the mechanism for pivoting the platform 22 and the receiving shaft 20 from a position wherein the receiving shaft is in a horizontal position as shown in FIG. 2 to a position wherein the receiving shaft is in a vertical position as shown in FIG. 8 will now be described.

As shown in FIG. 1, the apparatus preferably includes two hydraulic pistons and cylinders 50 and 51 to pivot the platform 22 about bearing 48 and a similar bearing on the opposite side of the bearing shown in FIG. 1 but obstructed from view by the shaft support 26.

The platform 22 is mounted with respect to carriage 18 by a pivot bearing 48. Pivoting of the platform 22 is accomplished by a hydraulic cylinder and piston 50 with a first end of the piston and cylinder 52 being pivotally connected to the carriage 18 at pivot bearing 52. A second end of the piston and cylinder is connected to a level arm 54 which is in turn connected to platform 22.

Referring to FIGS. 3 and 7, the receiving shaft 20 is in a horizontal position as it receives the coil 14. As soon as the coil 14 is loaded on shaft 20, the shaft 20 and platform 22 are tilted by an angle shown by arrow 24 to the position shown in the left part of FIG. 7. Preferably, the angle is between about 5 and about 10 degrees.

After the carriage 18 has been moved far to the right, the shaft 20 and the platform 22 are fully tilted to the position shown in the right-hand side of the FIG. 7. During the transport of the carriage from the position shown in the left-hand part of FIG. 7 to the position shown in the right-hand portion of FIG. 7, the shaft 20 is inclined by an angle as shown by the arrow 24 in order to safely retain the coil 14 on shaft 20. In addition, the shaft housing 26 takes up sufficient space that it would be impossible to turn the shaft to a fully vertical position because the floor would get in the way of the movement of the shaft housing 26. However, once the carriage reaches the position shown in the right-hand side of FIG. 7, there is a well 56 located immediately beneath the carriage 18. Thus, as shown by arrow 58, the shaft housing 26 makes a pivot into well 56 in the position shown in the right-hand side of FIG. 7, and the weight of the coil 14 is fully supported on platform 22.

As shown in FIGS. 1 through 8, the carriage 18 is guided in a linear path by a pair of guide wheels 60 and 62 which are attached to carriage 18. The wheels 60 and 62 ride in guide groove 64 that is located in the floor 66 on which the entire apparatus is placed. The path of movement of the wheels 60 and 62 in the guide groove 64 is preferably linear. The weight of the entire carriage is lifted with respect to floor 66 by a series of air bearings 68 that are of a conventional type and that permit the carriage 18 to slide with respect to floor 66 when the air bearings are activated. The location of the carriage with respect to the floor 66 is sensed by electromagnetic proximity switches 70 and 71. The proximity switches 70 and 71 sense the location of plates 72 and 74 so that the location of the carriage with respect to the slitter rewinder 10 can be sensed and controlled. More specifically as the carriage approaches plate 74, electromagnetic switch 70 senses and informs a controlling computer or other mechanism that the carriage is approaching its stop position. The mechanism for driving the carriage slows the carriage, and at the point where sensor 70 aligns with plate 72, the carriage comes to a halt and is in position for aligning receiving shaft 20 with storage shaft 12.

The operation of the coil unloading and transporting apparatus will now be described by sequential reference to FIGS. 2 through 8. As shown in FIG. 2, the coil 14 has been slit into a plurality of coil segments 16 and is ready to be unloaded from horizontal shaft 12. The air bearings 68 are actuated and the carriage 18 is powered by a source, not shown, in the direction of arrow 80. As the carriage 18 approaches the shaft 12, sensor 70 passes over plate 74 which transfers information to the control system, not shown, which slows the rate of speed to the carriage 18. Once the sensor 70 is in alignment with plate 72, the carriage comes to rest. An hydraulically driven locating pin 82 is inserted in a receptor 84 located in the floor. The pin 82 locks the carriage in place, and the air bearings 68 are deactuated so that the carriage comes to rest in the position shown in FIG. 3. At this point in time, the shaft axis 24 of shaft 12 is out of alignment with the shaft axis 86 of receiving shaft 20.

Referring to FIGS. 4, 5, and 6, the manner of aligning the ends of shafts 12 and 20 will now be described. Receiving shaft 12 includes a slot 88 that extends inwardly from the face 92 of the shaft 12. As best shown in FIG. 4, shaft 20 includes a central protrusion 94 that extends from the face 98 of shaft 20. As shown by the arrow 102 in FIG. 4, the shaft 12 is rotated until the slot 88 is aligned vertically. As shown in FIG. 6, shaft 20 is moved vertically downwardly as shown by arrow 104 to a position wherein the top surface of shaft 12 is flush with the top surface of shaft 20 so that the coils can slide smoothly between the shafts. The vertical movement of the shaft is accomplished by hydraulic piston and cylinder 38 which moves the shaft 20 vertically within slot 32 (slot 32 is shown in FIG. 1).

Referring once again to FIG. 3, once the shafts 12 and 20 are aligned, the coil 14 is pushed off of the shaft 12 by a pushing device 106 that moves the coil 14 in the direction of the arrow 108. At this point in time, the weight of the coil is fully transferred from shaft 12 to receiving shaft 20. The shaft 20 is raised vertically a small amount by motor 38.

The air bearings 68 are then actuated, and the entire carriage is moved in the direction of arrow 112 to the right to a position shown at the right-hand side of FIG. 7.

Simultaneously with the movement of the carriage, the shaft 20 and the platform 22 are tilted upwardly by an angle shown by arrow 24 in FIG. 7. The coil 14 may slide down the shaft 20 a short distance in the direction of arrow 110. In this position, a portion of the weight of the coil 14 is supported on shaft 20 and a portion is supported on platform 22.

Once the carriage 18 reaches the position shown in FIG. 7, the air bearings 68 are deactivated so that the carriage 18 comes to rest as shown in the right-hand side of FIG. 7. The piston and cylinder 50 is actuated further to swing the shaft 20 to a fully vertical position as shown by arrow 58 in FIG. 7. At this point in time, the entire weight of the coil 14 is supported on platform 22. Referring to FIG. 8, shaft 20 is withdrawn below the plane of the platform 22 by actuating hydraulic motor 28. At this point in time, the coil 14 is ready for movement in the direction of arrow 46. The coil 14 is supported by a plurality of rollers 42 that are driven by hydraulic motor 44 which is then actuated to move the coil to the right and onto an elongate conveyor which will now be described.

Referring to FIGS. 1, 3, 8, and 9, the elongate conveyor will be described. The conveyor 120 includes a platform 122 that is supported on a frame 124 so that it is the same height of platform 22 when platform 22 is in the position shown in FIG. 8. The conveyor, as shown in FIG. 1, comprises a large number of rollers 126 that are driven by a series of electric motors 128. The conveyor is divided into six sections, each section driven by a different motor 128, to permit control of each section, independent of the other. A plurality of photoelectric sensors 130 are positioned adjacent the upper surface of the conveyor 122 so that the location of the coil 14 on the conveyor can be sensed. The conveyor 120 has a length that is sufficient to store at least several coils. In this way, as the coils are unloaded from the platform 22, a group of coils can be stored for later handling by a crane.

Figure 9:
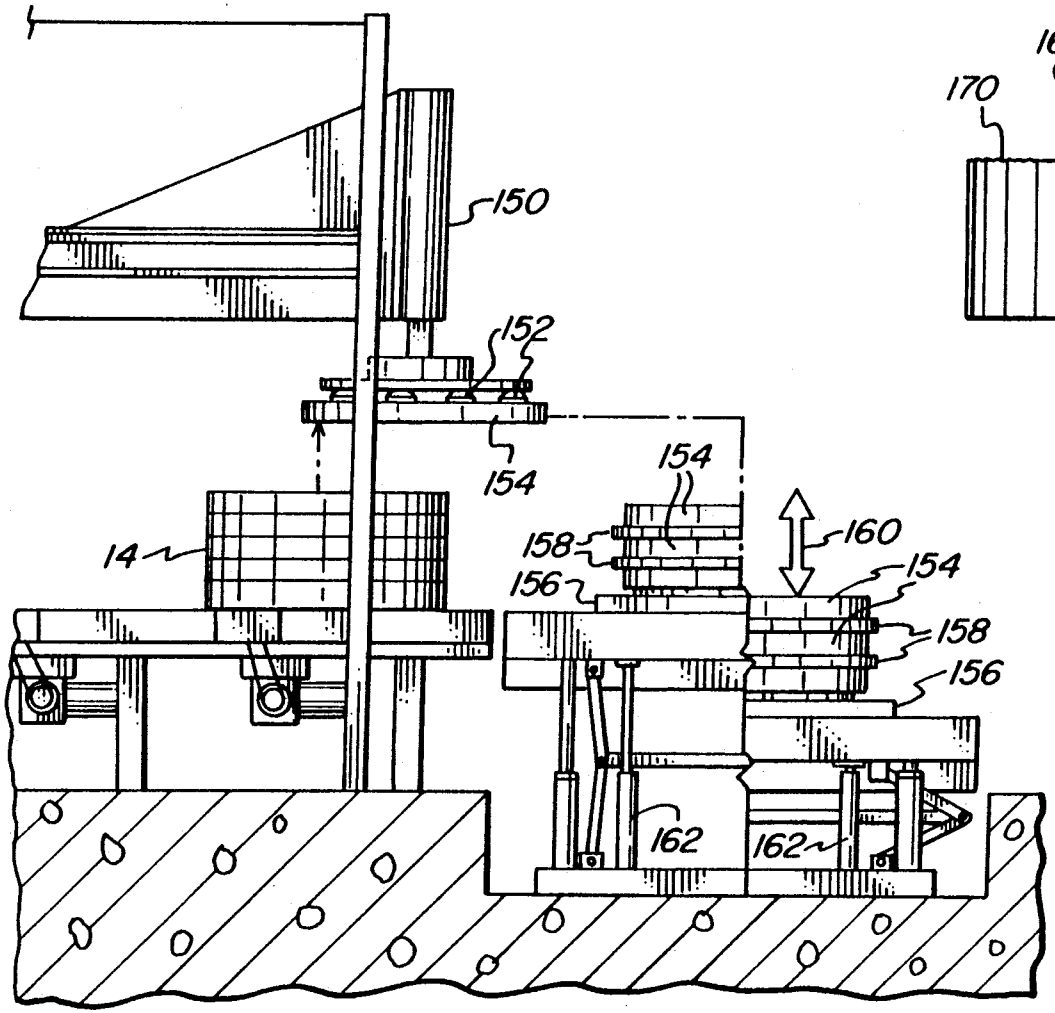
FIG. 9 is an end view similar to that shown in FIG. 8 of the coil segments being unloaded from the elongate conveyor to a pallet.

In accordance with one aspect of the invention, the conveyor further includes an overhead crane 132 that is movable in two directions. More specifically, referring to FIG. 8, the overhead crane is movable in a lateral direction as shown by arrow 134 and in a vertical direction as shown by arrow 136. The crane is driven by an electric motor 138, and runs lengthwise on support rails 140 and 142. The crane 132 is supported on a set of wheels 144 and is guided by guide wheels 146. Referring to FIGS. 8 and 9, when a coil 14 reaches the end of the conveyor, the coil segments are lifted individually upwardly by a hydraulically operated piston and cylinder 150 that is connected to a series of suction cups 152 that lift the individual coil segments 154 up and down and place the coil segments on a pallet 156. Each coil segment 154 is separated by a series of spacers 158 so that the coil segments are not damaged during shipping. Once the coil segments are packaged onto the pallet 156, the terminal portion of the conveyor is lowered in the direction of arrow 160 of FIG. 9 so that the pallet and the coils can be moved laterally onto a flatbed truck. The last segment of the conveyor can be operated by a series of hydraulic pistons and cylinders 162.

Figure 10:
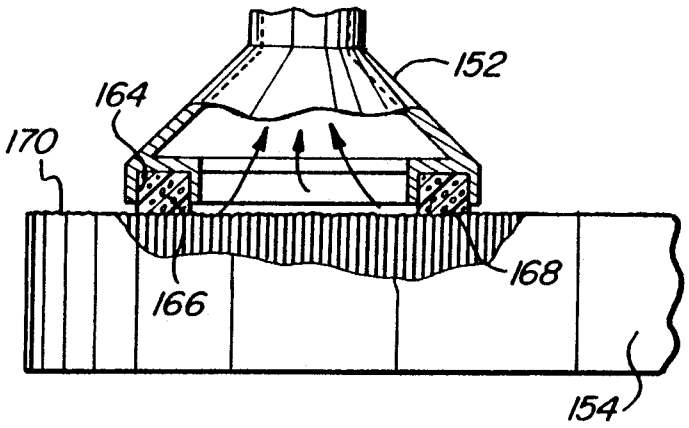
FIG. 10 is a partial cross sectional view of suction caps.

Referring to FIG. 10, a partial sectional view of the suction caps 152 is shown. The section cud includes an annular groove 164 for receiving annular seal 166. The seal 166 is made from resilient closed cell foam. The seal 166 provides a flat sealing surface 168 for contacting the coil surface 70. The sealing surface 168 deforms to accommodate and seal against the coil surface 170, which may be uneven because it is formed by the edge of a coil. In operation, the cup 152 is moved downwardly so that the sealing surface 168 contracts the coil surface 170. Air is withdrawn in the direction of arrows 172 in a conventional manner, and the coil is grasped by the group of cups 152.

As can be appreciated from the foregoing detailed description of the invention, a coil unloading and transporting device in accordance with the present invention provides numerous advantages over prior apparatus. In a relatively simple and quick motion, the coil is removed from the shaft of the slitter rewinder, transported to a remote location, tilted from a horizontal position to a vertical position and then moved via rollers on a platform to an elongate conveyor for handling of the individual coil segments. It is quite advantageous to be able to withdraw the receiving shaft below the plane of the platform so that the coil can be transported laterally without involving complicated equipment to remove the coil from the receiving shaft.

It should be understood that although specific embodiments of the invention have been described herein in detail, such description is for purposes of illustration only and modifications may be made thereto by those skilled in the art within the scope of the invention.

What is claimed is:

1. A coil unloading and transporting apparatus for a coil mounted on a storage shaft having a horizontal axis and having a top surface comprising:

a carriage supporting a shaft for receiving said coil, said receiving shaft having an axis and a top surface, said carriage being movable from a position adjacent said storage shaft to a position remote from said storage shaft;

a platform for supporting the coil, said platform being mounted on said carriage, said platform being located in a plane transverse to the axis of the receiving shaft, said receiving shaft and said platform being movable relative to each other from an extended position wherein the receiving shaft protrudes from the platform to a withdrawn position where the shaft is withdrawn below the plane of the platform;

means for pivoting said platform and said receiving shaft from a position wherein said receiving shaft is horizontal and the coil is supported on the receiving shaft to a position wherein said receiving shaft is vertical and the coil is supported on the platform;

means for aligning the top surface of said receiving shaft with the top surface of the storage shaft to enable transfer of said coil from said storage shaft to said receiving shaft; and means for moving said carriage adjacent to said storage shaft;

means for activating the alignment means to align said receiving shaft with said storage shaft to receive said coil;

means for moving said carriage to a remote position;

means for pivoting said platform and said receiving shaft from a horizontal position to a vertical position wherein the coil is supported on said platform; and means for moving said receiving shaft from said extended position to said withdrawn position to permit said coil to be transported laterally with respect to said platform.

2. An apparatus according to claim 1 wherein said carriage is movable to and away from said storage shaft in a linear path and wherein said storage shaft axis and said receiving shaft axis are aligned in a vertical plane.

3. An apparatus according to claim 2 wherein said means for aligning said storage shaft with said receiving shaft comprises means for moving the receiving shaft when it is in said horizontal position within said vertical plane to place said top surface of said receiving shaft in alignment with the top surface of said storage shaft, and each said shaft having an end, the shaft ends abutting to provide for transfer of the coil from the storage shaft to the receiving shaft.

4. An apparatus according to claim 1 wherein said platform includes means for moving a coil on the platform in a lateral direction.

5. An apparatus according to claim 4 wherein said lateral movement means comprises a series of elongate rollers aligned in a plane of the platform.

6. An apparatus according to claim 5 wherein said rollers are powered by motor drive means mounted on the carriage.

7. An apparatus according to claim 1 and further including means for guiding the carriage in said linear path from a position adjacent storage shaft to a position remote from said storage shaft.

8. An apparatus according to claim 7 wherein said guide means comprises at least one groove and wherein said carriage includes at least one wheel affixed to the carriage and running in said groove to guide said carriage during its movement.

9. An apparatus according to claim 1 and further including a support floor for said carriage and bearings for supporting the weight of said carriage during linear movement of said carriage.

10. An apparatus according to claim 9 wherein said bearings comprise air bearings for supporting the carriage during its movement.

11. An apparatus according to claim 1 wherein said means for moving the receiving shaft from a horizontal position to a vertical position comprises a pivot articulating said platform with respect to said carriage and motor means for pivoting said platform about said pivot from a position wherein said receiving shaft is horizontal to a position wherein said receiving shaft is vertical.

12. An apparatus according to claim 3 wherein said receiving shaft is mounted for vertical reciprocal movement in a slot in said platform to permit alignment of said receiving shaft with said storage shaft.

13. An apparatus according to claim 1 and further including means for locking said carriage in a position adjacent said storage shaft, said locking means being releasable to permit movement of said carriage to said remote position.

14. An apparatus according to claim 13 wherein said locking means comprising a locating pin fixed to said carriage, said locating pin mounted for vertical reciprocal motion in and out of a receptor in the support flooring.

15. An apparatus according to claim 1 and further including an electromagnetic sensor for sensing the location of the carriage and a support floor including metallic plates for tripping the electromagnetic sensors, said plates mounted with respect to said support floor.

16. An apparatus according to claim 1 wherein said platform comprises a plurality of rollers located in said plane, said rollers being rotatably driven to permit transfer of a coil placed thereon.

17. An apparatus according to claim 16 and further including an elongate conveyer positioned immediately adjacent the carriage in its remote position and located at a height for receiving the coil directly from the platform, the elongate conveyor comprising a plurality of rollers driven at the same speed as the platform rollers to permit said coil to be transferred from said platform to said elongate conveyor.

18. An apparatus according to claim 17 and further including an overhead crane associated with said elongate conveyor, said crane being movable laterally in a direction along the path of movement of the coils on the elongate conveyor and also movable vertically, said crane including means for grasping said coil to remove it from said elongate conveyor and place it in a position remote from said elongate conveyor.

19. An apparatus according to claim 18 wherein said grasping means comprises a plurality of circular air suction heads, each head including an annular seal comprising resilient closed cell foes, each said seal providing an annular flat sealing surface for contacting the coil surface, said sealing surface deforming to accommodate and seal against said coil surface.

20. A method for unloading a coil from a horizontal storage shaft and for transporting the coil to a remote location, the method comprising:

aligning a horizontal receiving shaft with said horizontal storage shaft and butting the end portions of said shafts in face to face relation, said receiving shaft protruding from a platform located in a plane transverse to said receiving shaft;

unloading said coil from said storage shaft to said receiving shaft to a position wherein the coil is supported on the receiving shaft;

moving said shaft and said platform from a position adjacent the storage shaft to a position remote from said storage shaft;

moving said receiving shaft and said platform from a position wherein said shaft is horizontal and bearing the weight of the coil to a position wherein said shaft is vertical and said platform bears the weight of the coil and the weight of the coil is released from said receiving shaft;

moving said receiving shaft from a position where it protrudes from the platform to a position where the shaft is withdrawn below the plane of the platform;

transferring the coil laterally with respect to the platform.

21. A method according to claim 20 wherein said movement of said receiving shaft from a position adjacent said storage shaft to a position remote from said storage shaft comprises moving said receiving shaft in a linear path.

22. A method according to claim 20 wherein said alignment of said receiving shaft with said storage shaft comprises vertically moving said receiving shaft to a position wherein the receiving and storage shafts align.

23. A method according to claim 20 wherein said platform comprises a series of motor driven rollers and further including moving said platform to a position adjacent a means for conveying said coil to said remote location.

24. A method according to claim 23 wherein said means for conveying comprises a series of rollers, said rollers being located at the said height and being in parallel alignment with the rollers of the platform to provide for transfer of the coil from the platform to the conveying means.

25. A method for unloading a coil from a horizontal storage shaft, the method comprising:

(i) aligning a horizontal receiving shaft with said horizontal storage shaft and butting the end portions of said shafts in face to face relation, said receiving shaft protruding from a platform located in a plane transverse to said receiving shaft;

(ii) unloading said coil from said storage shaft to said receiving shaft to a position wherein the coil is supported on the receiving shaft;

(iii) moving said receiving shaft and said platform from a position adjacent the storage shaft to a position remote from said storage shaft;

(iv) moving said receiving shaft and said platform from a position wherein said shaft is horizontal and bearing the weight of the coil to a position wherein said platform bears the weight of the coil and the weight of the coil is released from said receiving shaft;

(v) moving said receiving shaft from a position where it protrudes from the platform to a position where the shaft is withdrawn below the plane of the platform; and (vi) transferring the coil laterally with respect to the platform by means, integral with the platform, for moving the coil.

* * * * *